US010018315B2

(12) United States Patent
Su

(10) Patent No.: US 10,018,315 B2
(45) Date of Patent: Jul. 10, 2018

(54) LIGHT SOURCE ASSEMBLY, AND HEADLAMP AND VEHICLE HAVING THE SAME

(71) Applicant: HON HAI PRECISION INDUSTRY CO., LTD., New Taipei (TW)

(72) Inventor: Yung-Jen Su, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 98 days.

(21) Appl. No.: 15/227,200

(22) Filed: Aug. 3, 2016

(65) Prior Publication Data

US 2017/0343177 A1 Nov. 30, 2017

(30) Foreign Application Priority Data

May 27, 2016 (TW) ..... 105116714 A

(51) Int. Cl.

| | |
|---|---|
| ***F21S 41/135*** | (2018.01) |
| ***F21S 41/64*** | (2018.01) |
| ***F21S 41/143*** | (2018.01) |
| ***F21S 41/255*** | (2018.01) |
| ***F21S 41/16*** | (2018.01) |

(52) U.S. Cl.
CPC ..... *F21S 41/135* (2018.01); *F21S 41/143* (2018.01); *F21S 41/16* (2018.01); *F21S 41/255* (2018.01); *F21S 41/645* (2018.01)

(58) Field of Classification Search
CPC ..... F21S 48/13; F21S 48/114; F21S 48/12; F21S 48/14; F21S 48/17; F21S 48/1715; F21S 48/1726; F21S 48/1731; F21S 48/1225; F21S 41/00; F21S 41/60; F21S 41/63; F21S 41/64; F21S 41/645; F21S 41/285; F21V 5/008
See application file for complete search history.

(56) References Cited

U.S. PATENT DOCUMENTS

| | | | | |
|---|---|---|---|---|
| 3,026,763 | A * | 3/1962 | Marks | B32B 17/10174 296/97.2 |
| 4,985,816 | A * | 1/1991 | Seko | B60Q 1/0023 362/268 |
| 9,128,344 | B2 * | 9/2015 | Chen | F21S 48/12 |
| 2015/0029409 | A1 * | 1/2015 | Chen | F21S 48/125 349/5 |
| 2015/0308636 | A1 * | 10/2015 | Daniels | F21S 48/114 362/19 |
| 2016/0131321 | A1 * | 5/2016 | Yamanaka | F21S 48/1145 362/513 |

* cited by examiner

*Primary Examiner* — Bao Q Truong
(74) *Attorney, Agent, or Firm* — ScienBiziP, P.C.

(57) ABSTRACT

A light source assembly for a headlamp of a vehicle includes a light source, a lens group, a light adjusting device, and a fluorescent layer. The light source emits light. The lens group increases an incident angle of the light from the light source while the light adjusting device, comprising three different types of crystal, can change an outgoing direction of light from the lens group, thereby adjusting an intensity of the light through different portions of the light adjusting device. The fluorescent layer is triggered by the light and different fluorescent layers can be compensated for by the light adjusting device to form a final emitted white light.

14 Claims, 6 Drawing Sheets

LIGHT SOURCE ASSEMBLY, AND HEADLAMP AND VEHICLE HAVING THE SAME

FIELD

The subject matter herein generally relates to a light source, a headlamp having a light source, and a vehicle having the headlamp.

BACKGROUND

Vehicles can employ headlamps which comprise light sources for emitting blue light beam, onto yellow fluorescent layers. The yellow fluorescent layer comprises fluorescent powders which are triggered by the blue light beam to form yellow light beam. The blue light beam is then mixed with the yellow light beam to form white light beam for illumination purposes.

However, the fluorescing powders may not been distributed in the yellow fluorescent layer uniformly. Thus, different parts of the yellow fluorescent layer are not evenly triggered by the blue light beam, thus causing the laser beam travelling out of the headlamp to become slightly blue or slightly yellow.

BRIEF DESCRIPTION OF THE DRAWINGS

Implementations of the present technology will now be described, by way of example only, with reference to the attached figures.

DETAILED DESCRIPTION

Figure 1:
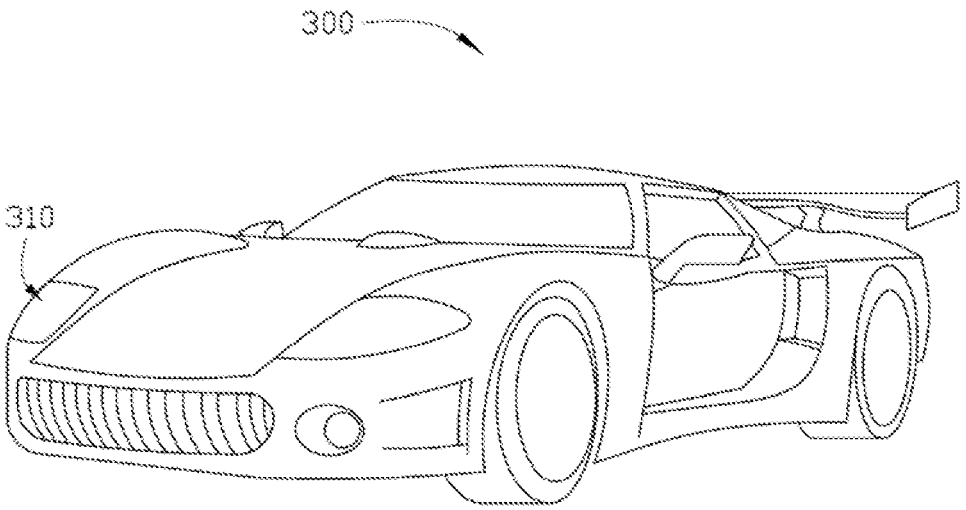
FIG. 1 is a diagrammatic view of an exemplary embodiment of a vehicle having a light source assembly of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Figure 2:
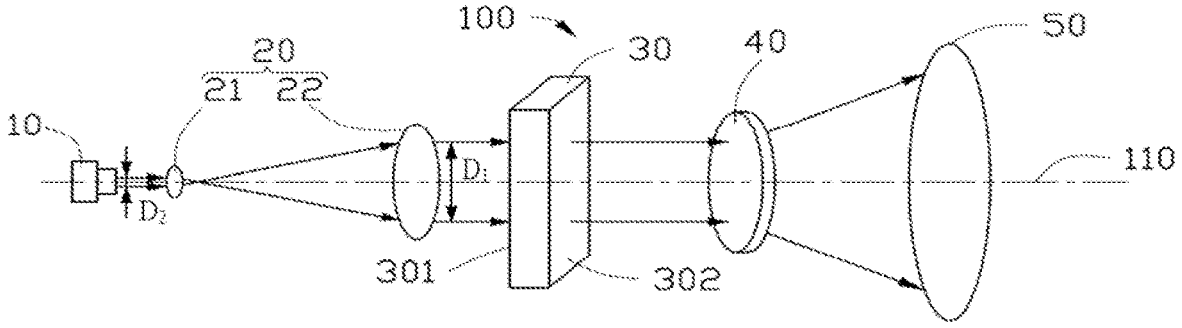
FIG. 2 is a diagrammatic view of the light source assembly of FIG. 1.

FIG. 1 illustrates an exemplary embodiment of a headlamp 310 of a vehicle 300. In FIG. 2, the headlamp 310 comprises a light source assembly 100. The light source assembly 100 comprises a light source 10, a lens group 20, a light adjusting device 30, a fluorescent layer 40, and a lens unit 50. The light source 10, the lens group 20, the light adjusting device 30, the fluorescent layer 40, and the lens unit 50 are successively positioned along a common axis 110.

The light source 10 emits light. In at least one exemplary embodiment, the light source 10 is a laser source or a light emitting diode (LED).

The lens group 20 increases an exit diameter of the light from the light source 10 while maintaining an exit angle of the light. In at least one exemplary embodiment, the lens group 20 comprises a divergent lens 21 and a convergent lens 22. The divergent lens 21 is positioned between the light source 10 and the convergent lens 22. The divergent lens 21 diverges the light from the light source 10. The convergent lens 22 converges the divergent light from the diverging lens 21. An exit diameter $D_1$ of the light from the convergent lens 22 is greater than the exit diameter $D_2$ of the light from the light source 10. An exit angle of the light from the convergent lens 22 substantially equals the exit angle of the light from the light source 10.

In other exemplary embodiments, the lens group 20 comprises a number of divergent lenses 21 and a number of convergent lenses 22 successively positioned along the axis 110. Thus, the lens group 20 can repeatedly diverge and converge the light to increase the exit diameter of the light from the light source 10 while maintaining the exit angle of the light.

The light adjusting device 30 changes an outgoing direction of at least one portion of the light from the lens group 20, thereby adjusting an intensity of the light passing through the portion of the light adjusting device 30.

In at least one exemplary embodiment, the light adjusting device 30 is made of liquid crystal material. When a voltage is applied to the light adjusting device 30, orientations of crystal lattices of the portion of the light adjusting device 30 are rearranged to change a refraction index of the light adjusting device 30, thereby changing the outgoing directions of the light passing through the light adjusting device 30.

Figure 3:
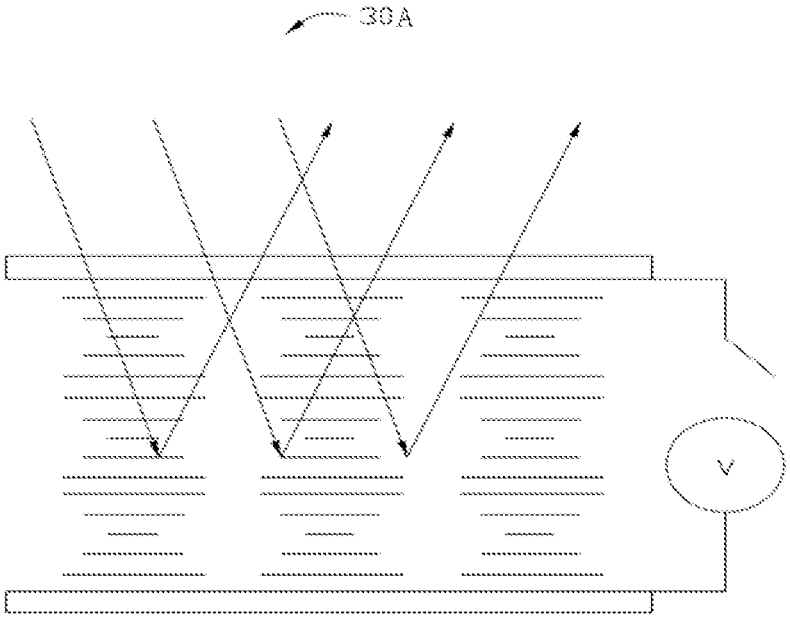
FIG. 3 is diagrammatic view showing a first working state of the light source assembly of FIG. 2.
Figure 4:
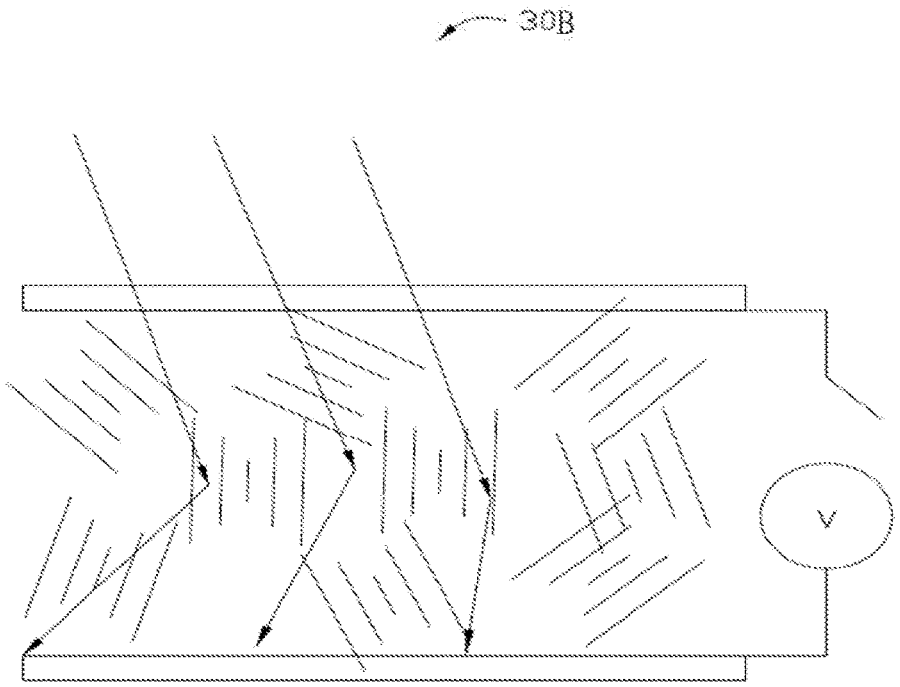
FIG. 4 is similar to FIG. 3, but showing a different working state of the light source assembly.
Figure 5:
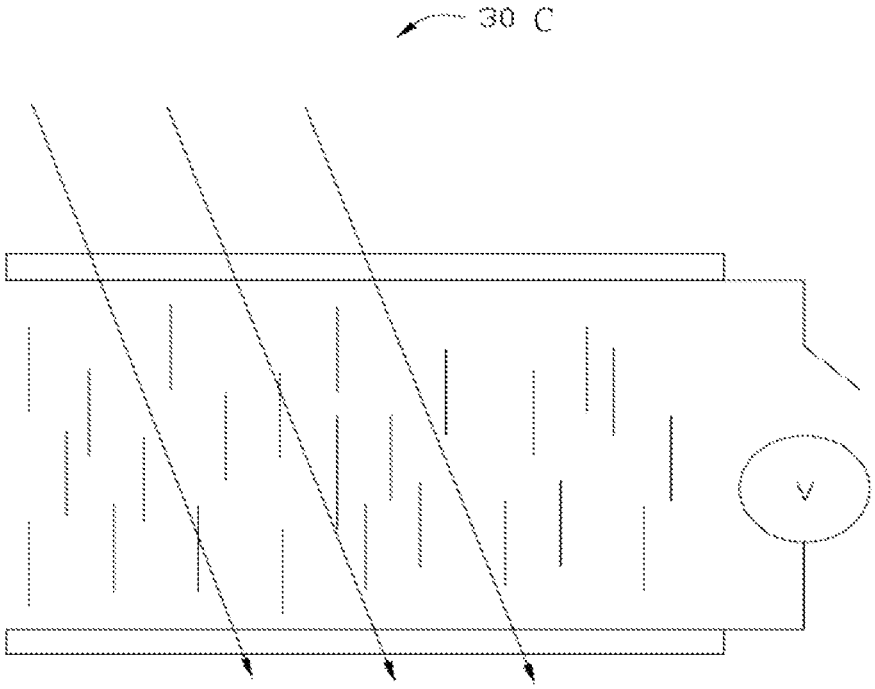
FIG. 5 is similar to FIGS. 3 and 4, but showing another different working state of the light source assembly.

FIGS. 3-5 illustrate the light adjusting device 30 adjusting the intensity of the light passing through a first portion 30A, a second portion 30B, and third portion 30C of the light adjusting device 30 made of different liquid crystal materials.

FIG. 3 illustrates the light adjusting device 30 adjusting the intensity of the light passing through the first portion 30A of the light adjusting device 30. When the voltage is applied to the light adjusting device 30, the orientations of the crystal lattices of the first portion 30A of the light adjusting device 30 are rearranged to be along a transverse direction to change the refraction index of the light adjusting device 30. Thus, the light from the lens group 20 is totally reflected by the crystal lattices towards the lens group 20, and the intensity of the light passing through the first portion 30A of the light adjusting device 30 decreases.

FIG. 4 illustrates the light adjusting device 30 adjusting the intensity of the light passing through the second portion 30B of the light adjusting device 30. When the same voltage is applied to the light adjusting device 30, the orientations of the crystal lattices of the second portion 30B of the light adjusting device 30 are rearranged to disorder the refraction index of the light adjusting device 30. Thus, the light is reflected by the crystal lattices towards the fluorescent layer 40, and the intensity of the light passing through the second portion 30B of the light adjusting device 30 increases.

FIG. 5 illustrates the light adjusting device 30 adjusting the intensity of the light passing through the third portion 30C of the light adjusting device 30. When the same voltage is applied to the light adjusting device 30, the orientations of the crystal lattices of the third portion 30C of the light adjusting device 30 are rearranged to be along a longitudinal direction to change the refraction index of the light adjusting device 30. Thus, the light directly passes through the crystal lattices, and the intensity of the light passing through the third portion 30C of the light adjusting device 30 remains unchanged.

Figure 6:
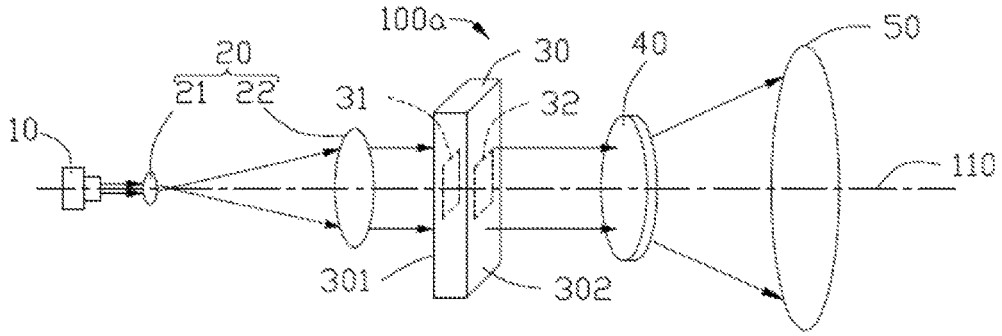
FIG. 6 is diagrammatic view of another exemplary embodiment of a light source assembly.

In another exemplary embodiment, the light adjusting device 30 is not made of liquid crystal material. FIG. 6 illustrates that the light adjusting device 30 comprises a light incident surface 301 and an opposite light emitting surface 302. The light adjusting device 30 further comprises a first polarizing splitter 31 and a second polarizing splitter 32 respectively arranged on the light incident surface 301 and the light emitting surface 302. The polarizing directions of the first polarizing splitter 31 and the second polarizing splitter 32 are different. A part of the light from the lens group 20 is reflected by the first polarizing splitter 31 towards the lens group 20, and a part of the remaining light is reflected by the second polarizing splitter 32 towards the lens group 20. Thus, the intensity of the light passing through the overall portion of the light adjusting device 30 can also be adjusted.

In other exemplary embodiments, the light adjusting device 30 is made of liquid crystal material, and also comprises the polarizing splitter 31 and the second polarizing splitter 32. In this case, the part of the parallel light from the lens group 20 is reflected by the first polarizing splitter 31 towards the lens group 20. The remaining parallel light is totally reflected by the crystal lattices towards the lens group 20, or towards the lens converting device 40, or can pass directly through the crystal lattices. A part of the remaining parallel light is then reflected by the second polarizing splitter 32 towards the lens group 20. Thus, the intensity of the intensity of the light passing through the portion of the light adjusting device 30 is adjusted.

The fluorescent layer 40 comprises fluorescent powders which can be triggered by the light from the light adjusting device 30 to fluoresce and emit a complementary light which has light color complementary to the light from the light adjusting device 30. The complementary light beam is mixed with the light to form white light.

In at least one exemplary embodiment, the light source 10 emits blue light. The fluorescent layer 40 comprises yellow fluorescent powders which can be triggered by the blue light to emit yellow light. The yellow light is mixed with the blue light to form the white light.

The lens unit 50 diverges or converges the white light from the fluorescent layer 40. In at least one exemplary embodiment, the lens unit 50 is a divergent or convergent lens.

With the above configuration, even if the fluorescent powders comprised in the fluorescent layer 40 are not distributed uniformly, the intensity of light passing through different portions of the light adjusting device 30 can be adjusted according to amounts of the fluorescent powders distributed in different parts of the fluorescent layer 40, thus compensating for different parts of the fluorescent layer 40 and enabling the light travelling out of the headlamp to be white.

It is to be understood, even though information and advantages of the present exemplary embodiments have been set forth in the foregoing description, together with details of the structures and functions of the present exemplary embodiments, the disclosure is illustrative only; changes may be made in detail, especially in matters of shape, size, and arrangement of parts within the principles of the present exemplary embodiments, to the full extent indicated by the plain meaning of the terms in which the appended claims are expressed.

What is claimed is:

1. A light source assembly comprising:

a light source configured to emit light;

a lens group configured to increase an exit diameter of the light from the light source while maintaining an exit angle of the light;

a light adjusting device configured to change an outgoing direction of at least one portion of the light from the lens group, thereby adjusting an intensity of the light passing through the at least one portion of the light adjusting device; and a fluorescent layer comprising fluorescent powders configured to be triggered by the light from the light adjusting device to a complementary light, the complementary light beam being mixed with the light to form white light;

wherein the light adjusting device is made of liquid crystal material; orientations of crystal lattices of the at least one portion of the light adjusting device are rearranged when a voltage is applied to the light adjusting device to change a refraction index of the light adjusting device, thereby changing the outgoing directions of the light passing through the at least one portion of the light adjusting device; the orientations of the crystal lattices of the at least one portion of the light adjusting device are able to be rearranged to be along a transverse direction to cause the light from the lens group to be totally reflected by the crystal lattices towards the lens group, to be rearranged to be disordered to cause the light to be reflected by the crystal lattices towards the fluorescent layer, and to be rearranged along a longitudinal direction whereby the light directly passes through the crystal lattices.

2. The light source assembly of claim 1 further comprising a lens unit configured to diverge or converge the white light from the fluorescent layer.

3. The light source assembly of claim 2, wherein the light source, the lens group, the light adjusting device, the fluorescent layer, and the lens unit are successively positioned along a common axis.

4. The light source assembly of claim 1, wherein the lens group comprises a divergent lens and a convergent lens; the divergent lens is positioned between the light source and the convergent lens; the divergent lens diverges the light from the light source; the convergent lens converges the divergent light from the diverging lens; an exit diameter of the light from the convergent lens is greater than the exit diameter of the light from the light source; an exit angle of the light from the convergent lens substantially equals to the exit angle of the light from the light source.

5. The light source assembly of claim 1, wherein the light adjusting device comprises a light incident surface and an opposite light emitting surface; the light adjusting device further comprises a first polarizing splitter and a second polarizing splitter respectively arranged on the light incident surface and the light emitting surface; polarizing directions of the first polarizing splitter and the second polarizing splitter are different; a part of the light from the lens group is reflected by the first polarizing splitter towards the lens group; and a part of a remaining light is reflected by the second polarizing splitter towards the lens group, thereby changing the outgoing directions of the light passing through the at least one portion of the light adjusting device.

6. A headlamp comprising:

a light source assembly comprising:

a light source configured to emit light;

a lens group configured to increase an exit diameter of the light from the light source while maintaining an exit angle of the light;

a light adjusting device configured to change an outgoing direction of at least one portion of the light from the lens group, thereby adjusting an intensity of the light passing through the at least one portion of the light adjusting device; and a fluorescent layer comprising fluorescent powders configured to be triggered by the light from the light adjusting device to a complementary light, the complementary light beam being mixed with the light to form white light;

wherein the light adjusting device is made of liquid crystal material; orientations of crystal lattices of the at least one portion of the light adjusting device are rearranged when a voltage is applied to the light adjusting device to change a refraction index of the light adjusting device, thereby changing the outgoing directions of the light passing through the at least one portion of the light adjusting device; the orientations of the crystal lattices of the at least one portion of the light adjusting device are able to be rearranged to be along a transverse direction to cause the light from the lens group to be totally reflected by the crystal lattices towards the lens group, to be rearranged to be disordered to cause the light to be reflected by the crystal lattices towards the fluorescent layer, and to be rearranged along a longitudinal direction whereby the light directly passes through the crystal lattices.

7. The headlamp of claim 6, wherein the light source assembly further comprises a lens unit configured to diverge or converge the white light from the fluorescent layer.

8. The headlamp of claim 7, wherein the light source, the lens group, the light adjusting device, the fluorescent layer, and the lens unit are successively positioned along a common axis.

9. The headlamp of claim 6, wherein the lens group comprises a divergent lens and a convergent lens; the divergent lens is positioned between the light source and the convergent lens; the divergent lens diverges the light from the light source; the convergent lens converges the divergent light from the diverging lens; an exit diameter of the light from the convergent lens is greater than the exit diameter of the light from the light source; an exit angle of the light from the convergent lens substantially equals to the exit angle of the light from the light source.

10. The headlamp of claim 6, wherein the light adjusting device comprises a light incident surface and an opposite light emitting surface; the light adjusting device further comprises a first polarizing splitter and a second polarizing splitter respectively arranged on the light incident surface and the light emitting surface; polarizing directions of the first polarizing splitter and the second polarizing splitter are different; a part of the light from the lens group is reflected by the first polarizing splitter towards the lens group; and a part of a remaining light is reflected by the second polarizing splitter towards the lens group, thereby changing the outgoing directions of the light passing through the at least one portion of the light adjusting device.

11. A vehicle comprising;

a headlamp comprising:

a light source assembly comprising:

a light source configured to emit light;

a lens group configured to increase an exit diameter of the light from the light source while maintaining an exit angle of the light;

a light adjusting device configured to change an outgoing direction of at least one portion of the light from the lens group, thereby adjusting an intensity of the light passing through the at least one portion of the light adjusting device; and a fluorescent layer comprising fluorescent powders configured to be triggered by the light from the light adjusting device to a complementary light, the complementary light beam being mixed with the light to form white light;

wherein the light adjusting device is made of liquid crystal material; orientations of crystal lattices of the at least one portion of the light adjusting device are rearranged when a voltage is applied to the light adjusting device to change a refraction index of the light adjusting device, thereby changing the outgoing directions of the light passing through the at least one portion of the light adjusting device; the orientations of the crystal lattices of the at least one portion of the light adjusting device are able to be rearranged to be along a transverse direction to cause the light from the lens group to be totally reflected by the crystal lattices towards the lens group, to be rearranged to be disordered to cause the light to be reflected by the crystal lattices towards the fluorescent layer, and to be rearranged along a longitudinal direction whereby the light directly passes through the crystal lattices.

12. The vehicle of claim 11, wherein the light source assembly further comprises a lens unit configured to diverge or converge the white light from the fluorescent layer; the light source, the lens group, the light adjusting device, the fluorescent layer, and the lens unit are successively positioned along a common axis.

13. The vehicle of claim 11, wherein the lens group comprises a divergent lens and a convergent lens; the divergent lens is positioned between the light source and the convergent lens; the divergent lens diverges the light from the light source; the convergent lens converges the divergent light from the diverging lens; an exit diameter of the light from the convergent lens is greater than the exit diameter of the light from the light source; a an exit angle of the light from the convergent lens substantially equals to the exit angle of the light from the light source.

14. The vehicle of claim 11, wherein the light adjusting device comprises a light incident surface and an opposite light emitting surface; the light adjusting device further comprises a first polarizing splitter and a second polarizing splitter respectively arranged on the light incident surface and the light emitting surface; polarizing directions of the first polarizing splitter and the second polarizing splitter are different; a part of the light from the lens group is reflected by the first polarizing splitter towards the lens group; and a part of a remaining light is reflected by the second polarizing splitter towards the lens group, thereby changing the outgoing directions of the light passing through the at least one portion of the light adjusting device.

* * * * *